United States Patent [19]

Collins et al.

[11] 4,113,177

[45] Sep. 12, 1978

[54] COMPOSITE RAILROAD CROSS TIE WITH RAIL SUPPORT BLOCKS

[76] Inventors: Walter Collins, 9543 Achates Cir.; Howard Blankumsee, 9324 Quesada Way, both of Sacramento, Calif. 95826

[21] Appl. No.: 785,834

[22] Filed: Apr. 8, 1977

[51] Int. Cl.[2] ..... E01B 3/18

[52] U.S. Cl. ..... 238/72; 238/83; 238/104; 238/377

[58] Field of Search ..... 238/72, 75–78, 238/83, 104, 283, 294, 377

[56] References Cited

U.S. PATENT DOCUMENTS

| | | | |
|---|---|---|---|
| 756,815 | 4/1904 | Beezer | 238/83 |
| 990,696 | 4/1911 | Berrier | 238/78 |
| 1,001,516 | 8/1911 | Driscoll | 238/72 |
| 1,146,721 | 7/1915 | Lewis | 238/75 |
| 1,198,289 | 9/1916 | Thomas | 238/73 |
| 1,495,288 | 5/1924 | Wilson | 238/78 |
| 1,650,235 | 11/1927 | Rohm | 238/76 |
| 2,822,986 | 2/1958 | Schreier | 238/377 |
| 3,549,090 | 12/1970 | Toyama | 238/283 |
| 3,610,526 | 10/1971 | Burwell | 238/283 |

FOREIGN PATENT DOCUMENTS

| | | | |
|---|---|---|---|
| 409,817 | 5/1934 | United Kingdom | 238/283 |

*Primary Examiner*—Albert J. Makay
*Assistant Examiner*—Carl Rowold
*Attorney, Agent, or Firm*—Blair, Brown & Kreten

[57] ABSTRACT

The present invention relates to an apparatus for retaining the rails of a railroad on the cross ties. Also disclosed herein is a novel railroad cross tie which has superior life expectancy as well as damping capability and is highly resistant to the elements of nature.

A hollow metallic tie element has disposed therein a plurality of support blocks which are constrained within the tie member. An overlying rail member is secured to the tie through the block members by bolt means which run between the rail, tie dampers, and support collars.

4 Claims, 4 Drawing Figures

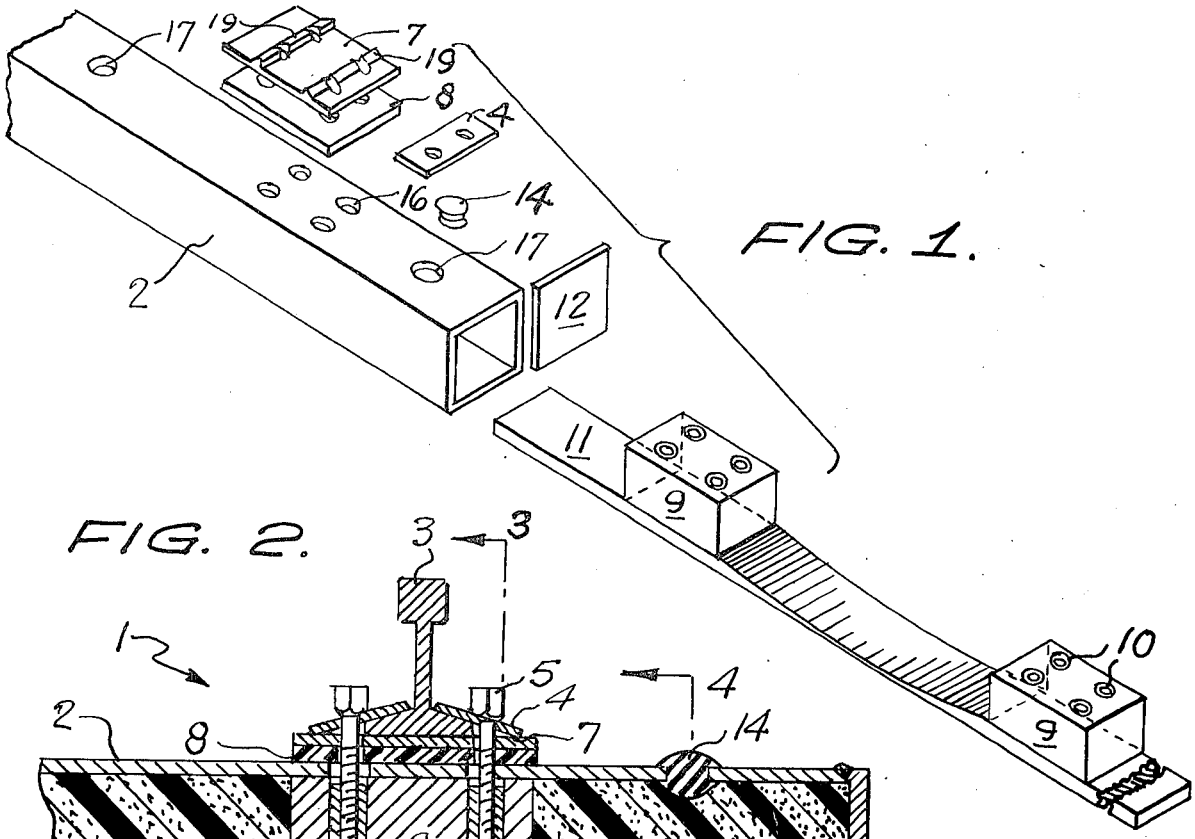
FIG. 1.
FIG. 2.
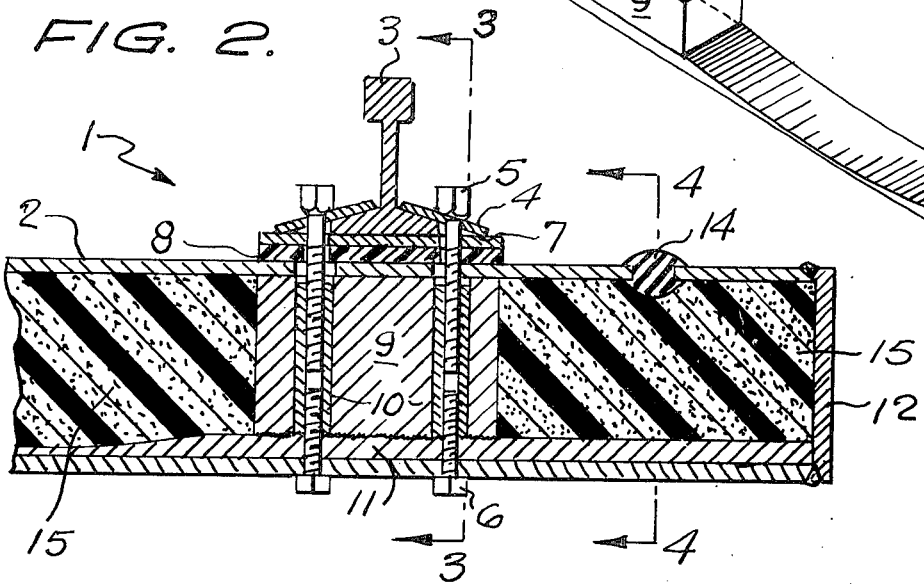
FIG. 3.
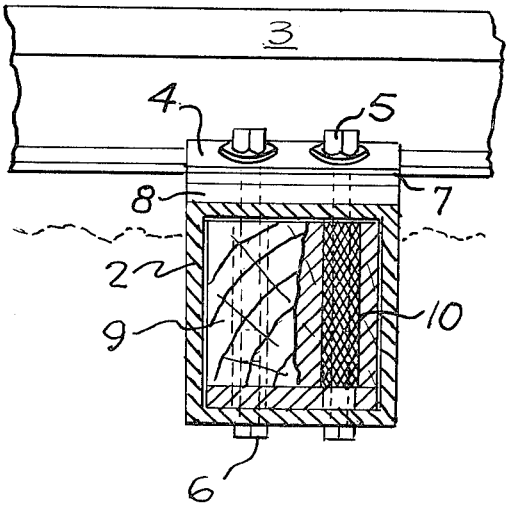
FIG. 4.
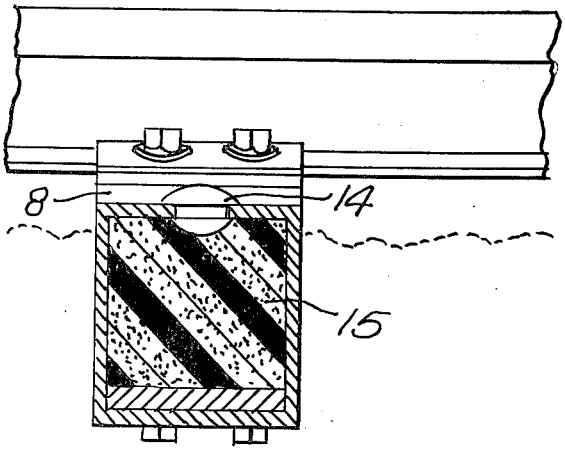

COMPOSITE RAILROAD CROSS TIE WITH RAIL SUPPORT BLOCKS

BACKGROUND OF THE INVENTION

FIELD OF THE INVENTION

The present invention relates to an apparatus for retaining railways on their cross tie members. Also disclosed herein are novel means for retaining and preserving the cross tie members.

Conventional railroad cross ties are comprised of very dense wood having no protective barrier on its outer extremity. The problems with such a wooden railroad tie include weathering and age and subsequent failure to rotting or fatique due to frequent loading. Accordingly the following specification is directed to an improved railroad tie which is far more resistant to the above identified problems associated with railroad ties. The resulting railroad tie described hereinbelow affords greater load bearing capacity as well as resistance to the elements. In addition the useful life of this railroad tie will be appreciably longer than that of the conventional tie and failure due to retension of the rail to the tie will have been minimized, thereby obviating bowed out sections which in the past have been a source of derailments.

SUMMARY OF THE INVENTION

Accordingly it is an object of this invention to provide a railroad cross tie which overcomes all the previous cited defects in the existing state of the art.

It is an object of this invention to provide a railroad tie which is resistant to the elements. It is a further object of this invention to provide a railroad tie which more securely retains the rail member then the prior art devices have been able to do.

It is a further object of this invention to provide damping of the vibrations caused by the passage of a train on the track overlying these cross ties to minimize fatique and sebsequent failure due to the cyclical loads imposed by the train on the rail and therefore the cross tie.

These objects and other objects will become apparent when considering the following drawings with the attendant specification.

BRIEF DESCRIPTION OF THE DRAWINGS

FIG. 1 shows an exploded parts view of the assembly details for the railroad tie in the instant invention;

FIG. 2 shows a cross sectional view of the tie box assembly seen in FIG. 1 with the inclusion of the rail member;

FIG. 3 shows a sectional view taken along the line 3—3 of FIG. 2; and

FIG. 4 shows an alternative sectional view taken along the lines 4—4 of FIG. 2.

DESCRIPTION OF THE PREFERRED EMBODIMENT

Referring now to the drawings in detail wherein like reference characters indicate like parts throughout the several figures, the reference numeral 1 generally indicates the cross tie and rail assembly best seen in FIG. 2. The cross tie generally comprises a hollow box member 2 of rectangular section having end plates 12 at either extremity. Typically these rectangular box members have the same geometrical configuration of conventional wooden ties and are found to be approximately 8 inches square by 8 feet long.

Disposed within the hollow box member are block members 9 which are separated and constrained from motion by board member 11 which has a curved contour at the portion between the two blocks as seen in FIG. 1. Disposed within these block members 9 are bushings 10 best seen in FIGS. 1, 2 and 3 which have a knurled outer surface and a threaded inner surface whose threads correspond to the thread pitch of bolts 5. These bushings 10 are driven into the block members 9 and the knurled outer portion retards rotation of the bushings when force is applied to it. These knurled outer faces also tend to retard and resist vertical displacement in either the positive or negative sense. Block member 9 is preferably made of wood, and from an ecological point of view may be fabricated from existing wooden railroad ties which are to be replaced.

The hollow box member is preferably made of steel and may be extruded or welded into its rectangular configuration by any method well known in the art. Its outer surface is to be coated with a special weathering inhibitor to retard the effects of the environment on its surface. FIG. 2 shows the block member assembly installed within the hollow box member and has a plate member 12 sealing preferably by welding its outer extremity. It will be apparent that once the block member 9 and its associated board 11 is inserted into the cavity of the box and plate members 12 which exist on both extremities of the box are in place the block members are constrained from moving within the box. Additional constraints which retard motion of these blocks include the bolt members 6 of FIG. 2 put in the bottom portion of the block and extend within the bushings 10 of the block member through holes in the bottom portion of the box member, and the sand generally denoted as 15 which provides additional constraint and will be discussed further hereinafter.

FIG. 2 shows rail members 3 which overlie block member 9 and is separated from the block member by one wall of the box member as well as damping material 8 and support plate 7. Bolts 5 are seen in FIG. 2 to pass through collars 4 which overlie a portion of the rail bottom, and extend through support plates 7 and damping material 8 through holes 16 of box member 2 (best seen in FIG. 1) and thereon into block member 9 through the threads provided by bushings 10 which have been discussed above. It is important to note that damping member 8 also serves as an insulator so that rail signals will not be interferred with by grounding the rail member to the box member. It is important that the rail member should be insulated from the box.

The views depicted in FIGS. 3 and 4 show how collar 4 distribute the force exerted by bolts 5 over a larger surface area of track then would normally be possible without these collars, in FIG. 2 it shows how support plate 7 tends to constrain the rail member and act as a guide when the track is being layed down by virtue of the upstanding tangs 19 in FIG. 1 disposed thereon.

FIG. 1 shows plug member 14 oriented above orifice 17 and provides an access hole or orifice to fill the sand material 15 within the hollow box member. As pointed out above sand 15 provides additional constraint in retarding motion of block members 9, however it also serves the important function of increasing the overall weight of the rail members while not sacrificing an appreciable amount of structural rigidity. The sand provides additional rigidity and weight at a modest price and is easy to attain. The sand is injected into the hollow box member at points 17 and plug members 14 are disposed thereover to provide a seal. Besides serving to increase the overall weight of the railroad tie assembly, the sand is seen to provide a source of vibration atenuation over the expanse of the beam, thereby minimizing and retarding injurious vibrations which will cause system failures due to fatique.

FIG. 3 shows a depiction of the grain structure of the wooden blocks 9 used in this invention, and it will be appreciated from this drawing that the grain structure of the blocks is oriented in a substantially horizontal fashion. This serves to provide greater overall compressive resistants to the loading impossed by the weight of a train on the rail member 3.

Other embodiments and configurations may be used without departing from the spirit and scope of the claims. Having thus described the preferred embodiment of the invention it should be understood that numerous structural modifications and adaptations may be resorted to without departing from the spirit of the invention.

What is claimed is:

1. A railroad cross tie comprising a hollow box member of rectangular configuration, block members positioned within the hollow of said box member provided with means to fixedly constrain their position in said box member, rail members overlying said block members disposed exteriorly of said box member and transverse thereto having means to fasten said rail members to said block members, and having means to insulate and damp said rail members from said box member, whereby said means to fixedly constrain includes a board member which is attached to said block members along their bottom surface, and end plates which are fastened to the openings of said hollow box member, and said means to fixedly constrain further includes sand injected within said hollow box member through a hole having a plug element and said means to fasten said rail members to said block members includes at least one bushing disposed within said block members having a knurled outer surface and threaded inner surface, an opening in said hollow box member in registry with said bushing, a support plate overlying said box having an opening which registers with said opening in said hollow box, a rail which overlies said support plate but does not extend over said support plate hole, collar means overlying a portion of said rail having a hole therein in registry with said support plate's hole, and bolt means threadedly fastened to said bushing while extending through said collar, support plate, and box member.

2. The tie of claim 1 in which said support plate has at least one upstanding tang portion to serve as a guide for said rail.

3. The tie of claim 2 in which said block members are fixedly constrained by bolt means extending from the lower portion of said box member, through said board member, and into said bushing of said block.

4. The tie of claim 3 in which said means to insulate and damp comprises a pad disposed between said support plate and said box member.

* * * * *